United States Patent [19]

Kondo et al.

[11] 4,346,146

[45] Aug. 24, 1982

[54] POROUS FLAME RETARDANT ACRYLIC SYNTHETIC FIBERS AND A METHOD FOR PRODUCING THESE FIBERS

[75] Inventors: Yoshikazu Kondo; Toshihiro Yamamoto; Takaji Yamamoto, all of Hofu, Japan

[73] Assignees: Kanebo, Ltd., Tokyo; Kanebo Synthetic Fibers, Ltd., Osaka, both of Japan

[21] Appl. No.: 156,994

[22] Filed: Jun. 6, 1980

[30] Foreign Application Priority Data

Jun. 18, 1979 [JP] Japan ..... 54-77048
Jun. 18, 1979 [JP] Japan ..... 54-77049

[51] Int. Cl.[3] ..... D02G 3/00

[52] U.S. Cl. ..... 428/398; 260/DIG. 23; 264/177 F

[58] Field of Search ..... 428/398, 376, 373, 374, 428/364; 260/DIG. 32, 17 R, DIG. 23; 521/149; 525/203; 264/41, 177F, 45.9, 45.8, 46.1

[56] References Cited

U.S. PATENT DOCUMENTS

| | | | |
|---|---|---|---|
| 2,528,200 | 10/1950 | Weinberg | 264/41 |
| 2,948,048 | 8/1960 | Jankens | 428/398 |
| 3,322,611 | 5/1967 | Stevenson | 428/398 |
| 3,542,715 | 11/1970 | White et al. | 264/41 |
| 3,575,898 | 4/1971 | McClure | 260/17 R |
| 3,729,531 | 4/1973 | Saling | 525/203 |
| 3,846,226 | 11/1974 | Smithey | 428/373 |
| 3,963,790 | 6/1976 | Couchoud | 260/DIG. 32 |

*Primary Examiner*—Lorraine T. Kendell
*Attorney, Agent, or Firm*—Blanchard, Flynn, Thiel, Boutell & Tanis

[57] ABSTRACT

Porous flame retarded acrylic synthetic fibers consisting of cellulose acetate and a modacrylic copolymer containing vinyl chloride and/or vinylidene chloride are produced by spinning an organic solvent solution of a polymer consisting of cellulose acetate and the above described modacrylic copolymer into a coagulation bath, primarily drawing the spun fibers at a draw ratio of 2.5~8.0, drying the water swelled fibers at 100°~180° C. to a water content of no greater than 1.0% by weight and secondarily drawing the dried fibers under wet heat at a draw ratio of no greater than 3 times.

10 Claims, 1 Drawing Figure

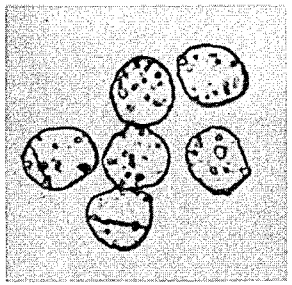

POROUS FLAME RETARDANT ACRYLIC SYNTHETIC FIBERS AND A METHOD FOR PRODUCING THESE FIBERS

The present invention relates to porous flame retardant acrylic synthetic fibers and a method for producing these fibers.

Natural fibers, such as cotton, wool, silk and others have a water absorption property of 20–40% and absorb satisfactorily the perspired sweat, so that a pleasant feeling is obtained during wear thereof. Synthetic fibers are low in the antistatic property and hygroscopicity and have no water absorption property and sweat absorption property and, therefore, synthetic fibers are inferior to natural fibers in commercial value. Particularly, if underwears, stockings, blankets, sports wears, etc. have no water-and sweat-absorption property, the perspired sweat condenses on the fiber surface and such fibers become sticky and cause a cold feeling and they are poor in regulation of the body temperature and unpleasant feeling when wearing same can not be avoided.

For improving the water- and sweat-absorption property of synthetic fibers, various improvements have been heretofore proposed. The major part of the improvements consist in the formation of microvoids in the fibers or the formation of unevenness on the fiber surface. For example, Japanese Patent Laid Open Application No. 25,418/72, Japanese Patent Nos. 665,549 and 702,476 and Japanese Patent Application Publication No. 6,650/73 have disclosed processes for producing porous acrylic fibers by selecting such a mild drying condition that microvoids remain in swelled gel tow during production step of acrylic fibers. Furthermore, Japanese Patent Laid Open Application No. 25,416/72, Japanese Patent Application Publication Nos. 8,285/73 and 8,286/73 have disclosed that a water soluble compound is incorporated in the swelled gel tow during the production of acrylic fibers and the swelled gel tow is dried and after-treated, after which the water soluble compound is dissolved off to form voids. The common concept in the above described processes consists in that microvoids inherently formed during the production of the acrylic fibers remain in the final product to obtain porous acrylic fibers. The microvoids formed in the swelled gel tow are very thermally unstable. In particular, modacrylic copolymers containing no greater than 80% by weight of acrylonitrile are most unstable. Therefore, it is impossible to effect treatment at a high temperature at the steps for producing the fibers, particularly at the drying, shrinking and crimp setting steps, and the heat resistance, form stability and crimp stability of the final product are poor and the commercial value of the product is considerably deteriorated. The radius of the voids in the obtained product is very small, such as 10–1,000 Å. Since numerous microvoids are uniformly distributed in the fibers, the strength and elongation of the fibers are low, the luster is poor and the dyed color is not clear. Furthermore, since numerous microvoids are uniformly distributed, the heat resistance of the fibers is low and in a high temperature dyeing, steaming treatment, pressing treatment and the like, voids are eliminated, the water absorption property is deteriorated, the color tone is varied and the form stability is deteriorated and the qualities are degraded.

When it is attempted to develop the water absorption property by these voids, the microvoids are apt to be formed as closed voids and passages hardly form through which water is absorbed into the fibers, so that this proposal is not effective. In order to obtain a certain degree of water absorption property, a fairly large number of microvoids are necessary and this further deteriorates the fiber properties and commercial value. It has been previously attempted to improve the feeling and the dyeability by mix-spinning of cellulose acetate-acrylic polymer or cellulose acetate-modacrylic copolymer. For example, Japanese Patent Nos. 222,873 and 243,556 and Japanese Patent Application Publication No. 14,029/64 have disclosed that the spinning solution obtained by mixing cellulose acetate with acrylic polymer or modacrylic copolymer is spun to obtain fibers having improved dyeability and feeling. The fibers obtained in these processes are dense and have no water absorption property due to voids in the fiber interior. In addition, Japanese Patent No. 433,941 has disclosed that cellulose acetate is added during polymerization of the acrylic polymer as a means for mixing cellulose acetate therein, but when the polymer obtained by mixing cellulose acetate during polymerization of the acrylic polymer, is used, the heat resistance of the spun fibers is deteriorated owing to the degradation of cellulose acetate and troubles occur during the steps for producing the fibers and a product having a satisfactory quality can not be obtained. Japanese Patent No. 556,549 and Japanese Patent Laid Open Application Nos. 118,027/75 and 118,026/75 have described that cellulose acetate or a mixture of cellulose acetate and titanium oxide and the like is finely distributed in an acrylic polymer or modacrylic polymer to obtain animal hair-like fibers, but can not provide porous fibers having a high water absorption property as is obtained in the present invention.

For the above described reasons, porous flame retardant acrylic synthetic fibers having improved water absorption property, heat resistance, dyeability and luster can not be obtained by the prior processes. The inventors have diligently studied to obviate the prior defects and accomplished the present invention.

An object of the present invention is to provide porous flame retardant acrylic synthetic fibers having an excellent water absorption property and good yarn properties.

Another object of the present invention is to provide a method for producing porous flame retardant acrylic synthetic fibers, having an excellent water absorption property and good yarn properties, commercially easily and cheaply.

THe present invention provides porous flame retardant acrylic synthetic fibers consisting of 2~50% by weight of cellulose acetate and 50~98% by weight of a modacrylic copolymer containing 20~60% by weight of vinyl chloride and/or vinylidene chloride, having a surface area A of voids of no greater than 15 $m^2/g$ and a porosity V of 0.05~0.75 $cm^3/g$, V/A being 1/30 or more.

The process of the present invention comprises spinning an organic solvent solution containing 15~35% by weight of a polymer consisting of 2~50 parts by weight of cellulose acetate and 50~98 parts by weight of a modacrylic copolymer containing 20~60% by weight of vinyl chloride and/or vinylidene chloride into a coagulation bath, primarily drawing the spun fibers at a draw ratio of 2.5~8 times, drying the fibers in water swelled state at a temperature of 100°~180° C. to a water content of no greater than 1.0% by weight and secondarily drawing the dried fibers under wet heat at a draw ratio of no greater than 3 times.

The flame retardant acrylic synthetic fibers according to the present invention consist of 2~50% by weight, preferably 5~30% by weight of cellulose acetate and 50~98% by weight, preferably 70~95% by weight of a modacrylic copolymer.

Cellulose acetate to be used in the present invention is not particularly limited but in general, is one having a combined acetic acid of 48~63% and an average polymerization degree of 50~300.

The modacrylic copolymers to be used in the present invention consist of 20~60% by weight of vinyl chloride and/or vinylidene chloride, less than 5% by weight of a copolymerizable monomer and acrylonitrile. The copolymerizable monomers, are for example alkyl acrylates or methacrylates, such as methyl acrylate, methyl methacrylate, ethyl acrylate, vinyl amides, such as acrylamide, methacrylamide, N-mono-substituted or N,N-disubstituted amides thereof, vinyl acetate, sulfonic acid group-containing vinyl unsaturated monomers, such as styrenesulfonic acid, allylsulfonic acid, methallylsulfonic acid and the salts thereof. In particular, when 0.5~3.0% by weight, of allylsulfonic acid or methallylsulfonic acid or the salts thereof is copolymerized, the dyeability is not only improved, but also the formation of numerous microvoids is prevented, whereby degradation of the heat resistance is prevented and the porous fibers having macrovoids and excellent water absorption property can be obtained.

When the content of vinyl chloride and/or vinylidene chloride is less than 20% by weight, the flame retardance is not satisfactory and the soft feeling inherent to the flame retardant acrylic synthetic fibers is insufficient, while when the content exceeds 60% by weight, the polymerizability, spinnability, heat resistance and yarn properties are deteriorated and these contents should be avoided. When the content of cellulose acetate in the fibers is less than 2% by weight, the phase separation from the modacrylic copolymer is insufficient and a satisfactory water absorption property can not be obtained, while when the content exceeds 50% by weight, the phase separation state becomes excessive and the strength, elongation, dyeability and luster of the fibers are deteriorated and nonuniformity occurs.

The modacrylic copolymer in the flame retardant acrylic synthetic fibers according to the present invention may contain an acrylic copolymer containing 5~30% by weight of a monomer having the general formula

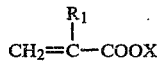

wherein X is $R_2$ or

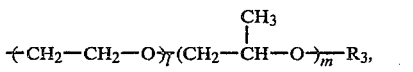

$R_1$ and $R_3$ are H or $CH_3$, $R_2$ is H, $NH_4$ or an alkali metal, and l and m are an integer of 0~50 and $0<l+m\leqq 50$, and the acrylic copolymer is no greater than about 33% by weight based on the total polymer composing the acrylic synthetic fibers, in order to improve the dispersability of cellulose acetate. As the monomers to be copolymerized in the acrylic copolymers shown by the above described general formula, acrylic acid, methacrylic acid and

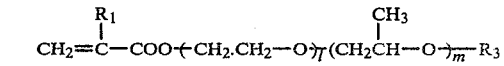

are preferable in view of the polymerizability, discoloration and resistance of water solubility. As the length of the ethylene glycol chain or the propylene glycol chain contained in these monomers is larger, the hydrophilic property of the acrylic copolymer is increased and the content is permitted to smaller, but when l+m exceeds 50, the polymerizability and solubility of the acrylic copolymer are degraded. As the monomers copolymerizable in the acrylic copolymer other than the monomers having the above described general formula, the above described monomers to be used in polymerization of the modacrylic polymers may be used. The acrylic copolymer contains at least 70% by weight of acrylonitrile.

The acrylic synthetic fibers according to the present invention have substantially no microvoids but have mainly macrovoids and the macrovoids contribute to the water absorption property. In the acrylic synthetic fibers according to the present invention, cellulose acetate is distributed in the elongated form having the longest dimension parallel to the fiber axis and the ratio of the length to the diameter of the elongated cellulose acetate is generally 10 or more. The fibers according to the present invention have mainly macrovoids and the macrovoids are formed by the phase separation of cellulose acetate and the modacrylic copolymer. The macrovoids greatly contribute to the water absorption property and the modacrylic copolymer component in the fibers has substantially the same degree of denseness as usual acrylic fibers and modacrylic fibers.

For better understanding of the invention, reference is taken to the accompanying drawing, wherein:

The drawing is an optical photomicrograph (magnification: 200 times) of the cross section of a flame retardant acrylic fiber according to the present invention.

The presence of a large member of macrovoids is observed from the drawing.

In the flame retardant acrylic synthetic fibers of the present invention, the surface area A of voids is no greater than 15 $m^2/g$, preferably 0.02~10 $m^2/g$, a porosity V is 0.05~0.75 $cm^3/g$, preferably 0.05~0.60 $cm^3/g$ and V/A is 1/30 or more, preferably 1/20 or more.

The surface area A($m^2/g$) of voids in the fibers was determined as follows. Nitrogen gas was adsorbed in the fiber at a temperature of liquid nitrogen, the total surface area of the fiber was determined by BET equation and from this value was subtracted the surface area of the outer skin of the fiber. The amount of the fiber to be measured was adjusted so that the value of the total surface area to be measured is 1 $m^2$ or more.

The porosity V($cm^3/g$) was determined as follows. The density $\rho$($g/cm^3$) of a film prepared so as to have the same composition as the fiber and a high denseness, was measured and an average cross sectional area of the fiber containing the voids was determined by photographic process and referred to as S($cm^2$) and an actual average cross sectional area So($cm^2$) of the fiber at the portion containing no voids was determined from the following equation (1) and the porosity V was determined from the following equation (2).

$$So = \frac{De}{900000 \times \rho} \quad (1)$$

De: Denier $$V = \frac{1}{\rho} \times \frac{S - So}{So} \quad (2)$$

When the porosity V is less than 0.05 $cm^3/g$, the water absorption property is not satisfied, while when the porosity V exceeds 0.75 $cm^3/g$, the strength and elongation of the fibers are degraded and the luster and dyeability are adversely affected, so that these values should be avoided.

When the surface area A of the voids exceeds 15 $m^2/g$, microvoids in the fibers increase and the strength and elongation are not only deteriorated but also the dyeability and heat resistance are deteriorated. When V/A is less than 1/30, the water absorption property is not satisfied or the heat resistance, dyeability and the like as well as the strength and elongation are deteriorated. Furthermore, it has been found from the experimental data of the inventors that when V/A is less than 1/30, the voids in the fibers becomes small and if the size is calculated into, for example sphere, the diameter becomes less than 2,000 Å and the excellent water absorption property can not be obtained and the strength and elongation are deteriorated.

The flame retardant acrylic synthetic fibers according to the present invention are produced by spinning an organic solvent solution containing 15~35% by weight, preferably 17~30% by weight, of a polymer consisting of 2~50 parts by weight, preferably 5~30 parts by weight, of cellulose acetate and 50~98 parts by weight, preferably 70~95 parts by weight, of modacrylic copolymer containing 20~60% by weight of vinyl chloride and/or vinylidene chloride into a coagulation bath. When the amount of cellulose acetate, and the modacrylic copolymer is beyond this range, the flame retardant acrylic synthetic fibers having an excellent water absorption property and yarn properties can not be obtained. When the concentration of the polymer is less than 15% by weight, the production cost becomes higher and the formation of microvoids increases to deteriorate the strength and elongation. When the concentration exceeds 35% by weight, the viscosity increases, whereby the operability and spinnability are deteriorated and further the yarn properties are degraded, so that these amounts should be avoided.

As the organic solvent to be used in the present invention, mention may be made of common solvents for cellulose acetate and the modacrylic copolymers but in general, organic solvents, such as dimethylformamide, dimethylacetamide, dimethylsulfoxide, ethylene carbonate and the like are preferable in view of recovery and purification of the solvents. As the coagulation bath, use may be made of an aqueous solution of an organic solvent, such as dimethylformamide, dimethylacetamide, dimethylsulfoxide, ethylene carbonate and the like, and organic solvents, such as propyl alcohol, kerosene and the like, but an aqueous solution of an organic solvent to be used for dissolving the polymer, the temperature of which is not higher than 30° C., is particularly preferable.

Water within the range which does not cause gellation of the spinning solution, and an agent for improving the flame retardance, such as antimony oxide, antimony chloride and the like may be added to the spinning solution. This addition of water is effective for controlling the viscosity of the spinning solution and preventing the formation of microvoids in the spun fibers. When the water content in the spinning solution is increased, the dispersed state of the elongated cellulose acetate becomes longer.

The process for mixing cellulose acetate and the modacrylic copolymer or mixing an acrylic copolymer to said mixture is not particularly limited. For example, each of the polymers is dissolved in a common solvent and the obtained solutions are mixed or these polymers are concurrently added and dissolved in a common solvent.

The spinning can be carried out under the same conditions as in usual modacrylic or acrylic synthetic fibers and several stages of spinning baths and drawing and water washing are carried out. The primary draw ratio is 2.5~8 times, preferably 3~6 times. When the primary draw ratio is less than 2.5 times, the drawing and orientation of the fibers are insufficient and therefore the strength is low and cracks are formed in the fibers and such a drawing should be avoided. While, when the draw ratio exceeds 8 times, the densification excessively proceeds and a satisfactory water absorption property can not be obtained and the operability is deteriorated, so that such draw ratio should be avoided.

In the primarily drawn fibers, the dispersion of the elongated cellulose acetate, and the voids formed by the phase separation of cellulose acetate and the modacrylic copolymer become more distinct. But the fibers contain a large number of microvoids inherently contained in the usual swelled gel tow. These microvoids are not desirable because of the deterioration of the heat resistance, dyeability and luster of the fibers. Hence, the fibers wherein the microvoids and macrovoids coexist, are dried to eliminate the microvoids but, in this case, the drying is carried out at a temperature of 100°~180° C., until the water content becomes no greater than 1.0% by weight, whereby only the microvoids are eliminated and the macrovoids formed due to the phase separation remain. When the drying temperature is lower than 100° C., the microvoids formed in the modacrylic copolymer can not be completely collapsed by drying and the strength and elongation, luster, dyeability and heat resistance of the fibers are deteriorated. While when the drying temperature exceeds 180° C., the fibers are hardened and discolored, so that such a temperature should be avoided. For drying, it is desirable for eliminating the microvoids to use a hot roller type dryer in which the fibers are brought into contact with a metal surface heated at a high temperature. In addition, if the drying is effected by blowing hot air at a temperature of 100°~150° C. as a supplemental means, the drying can be effected more uniformly, so that such a means is desirable.

The water content of dried fibers must be no greater than 1.0%. When the water content exceeds 1.0%, uneven drying of the fibers occurs and a large number of microvoids partially remain, resulting unevenness of dyeing, luster and strength of the fibers and the uniformity of quality is deteriorated. In this drying step, a torque motor may be used to effect shrinkage of 5~15% together with the drying.

The dried fibers should be subjected to a secondary drawing under wet heat to a draw ratio of no greater than 3 times, preferably 1.05~2 times, in order to make the phase separation of the modacrylic copolymer and cellulose acetate in the fibers more distinct and to elongate the macrovoid structure and improve the water absorption property and provide moderate physical properties of the fiber. When the draw ratio exceeds 3 times, yarn breakage occurs and if the temperature is raised in order to prevent yarn breakage, stickiness and melting of the fibers occurs and the water absorption property is considerably deteriorated. After the secondary drawing, the fibers are subjected to after-treating steps for imparting good spinnability and performance to the fibers, such as wet heat shrinking step, oiling step, crimping step and crimp-setting step to obtain the final product.

The porous acrylic synthetic fibers and the acrylic composite fibers according to the present invention can be produced by using not only an organic solvent but also an inorganic solvent, such as aqueous solution of zinc chloride and the like.

The porous flame retardant acrylic synthetic fibers obtained by the present invention have a high water absorption property and water absorbing rate and are excellent in strength and elongation under wet swelling when absorbing water, and have good luster and brightness when dyeing.

In natural fibers, the bulkiness and resilient feeling are lost upon wet swelling but in the porous flame retardant acrylic synthetic fibers according to the present invention, the water absorption is a physical mechanism in which water is absorbed in voids in the fibers, so that these fibers are not deteriorated in the bulkiness and resilient feeling and the water absorption property, water- and moisture-permeability are excellent. Furthermore, the fibers of the present invention contain 50~98% by weight of the modacrylic copolymer containing 20~60% by weight of vinyl chloride and/or vinylidene chloride, so that the flame retardance is high. Even if a few % by weight of a flame retardant, such as antimony oxide is added, the desired porous flame retardant acrylic synthetic fibers can be obtained without deteriorating the water absorption property, spinnability and yarn properties. In addition, the porous flame retardant acrylic synthetic fibers according to the present invention have a porosity of 0.05~0.75 $cm^3/g$ and are light in the weight and very high in the heat retaining property.

The porous flame retardant acrylic synthetic fibers of the present invention, having such many excellent properties which have never been obtained before, are optimum for clothing, sports wear, bedding cotton, curtain, interior and the like. Furthermore, these fibers are satisfactorily used in the fields where cotton has been used, as cotton substitutes. In particular, the fibers are optimum in the fields where the water absorption property and the flame retardance are required.

The following examples are given for the purpose of illustration of this invention and are not intended as limitations thereof. In the examples, parts and % mean parts by weight and % by weight unless otherwise indicated. The water absorption of the fiber was measured according to DIN-53814.

EXAMPLE 1

A dimethyl formamide (hereinafter abbreviated as DMF) solution containing 25% of a polymer mixture consisting of a modacrylic copolymer and cellulose acetate in a mixing ratio shown in the following Table 1 was extruded from a spinneret into a coagulation bath consisting of 60% of DMF and 40% of water and kept at 20° C. The modacrylic copolymer had a composition of acrylonitrile (hereinafter abbreviated as AN): vinylidene chloride (hereinafter abbreviated as VDC): sodium methallylsulfonate (hereinafter abbreviated as SMAS)=55:43:2(%). The extruded filaments were subjected to a primary drawing to draw the filaments to 5 times their original length, and then dried by means of a hot roller type drier kept at 120° C. until the water content of the filaments was decreased to 0.5%. The dried filaments were subjected to a secondary drawing at 100° C. under wet heat to draw the filaments to 1.5 times their original length. The drawn filaments were mechanically crimped and the crimps were set to obtain 3-denier flame-retardant acrylic synthetic fibers. The properties of the resulting fibers are shown in Table 1.

TABLE 1

| | Polymer mixture | | Void | | | Fiber property | | | |
|---|---|---|---|---|---|---|---|---|---|
| Experiment number | Modacrylic copolymer (parts) | Cellulose acetate (parts) | Porosity, V ($cm^3/g$) | Surface area, A ($m^2/g$) | V/A | Water absorption (%) | Strength (g/d) | Dyeability | Remarks |
| 1 | 100 | 0 | 0.00 | 0.00 | — | 3 | 3.5 | good | Comparative sample |
| 2 | 98 | 2 | 0.10 | 0.97 | $\frac{1}{9.7}$ | 14 | 3.5 | " | Present invention |
| 3 | 95 | 5 | 0.15 | 1.34 | $\frac{1}{8.9}$ | 18 | 3.3 | " | Present invention |
| 4 | 90 | 10 | 0.24 | 1.87 | $\frac{1}{7.8}$ | 27 | 3.0 | " | Present invention |
| 5 | 80 | 20 | 0.33 | 2.12 | $\frac{1}{6.4}$ | 35 | 2.6 | " | Present invention |
| 6 | 70 | 30 | 0.46 | 2.47 | $\frac{1}{5.4}$ | 48 | 2.4 | " | Present invention |
| 7 | 60 | 40 | 0.57 | 2.78 | $\frac{1}{4.9}$ | 58 | 2.1 | somewhat poor | Present invention |

TABLE 1-continued

| Experiment number | Polymer mixture: Modacrylic copolymer (parts) | Polymer mixture: Cellulose acetate (parts) | Void: Porosity, V ($cm^3/g$) | Void: Surface area, A ($m^2/g$) | Void: V/A | Fiber property: Water absorption (%) | Fiber property: Strength (g/d) | Fiber property: Dyeability | Remarks |
|---|---|---|---|---|---|---|---|---|---|
| 8 | 50 | 50 | 0.73 | 5.41 | $\frac{1}{7.4}$ | 74 | 1.9 | somewhat poor | Present invention |
| 9 | 40 | 60 | 0.96 | 9.13 | $\frac{1}{9.5}$ | 95 | 1.6 | poor | Comparative sample |

tions. The properties of the resulting fibers are shown in Table 2.

TABLE 2(a)

| Experiment number | Void: Porosity, V ($cm^3/g$) | Void: Surface area, A ($m^2/g$) | Void: V/A | Fiber property: Water absorption (%) | Fiber property: Others | Remarks |
|---|---|---|---|---|---|---|
| 10 | 1.01 | 34.7 | $\frac{1}{34.4}$ | 100 | low strength and poor dyeability | Comparative sample |
| 11 | 0.31 | 2.05 | $\frac{1}{6.6}$ | 34 | | Present invention |
| 12 | 0.55 | 21.3 | $\frac{1}{38.7}$ | 56 | low strength and poor dyeability | Comparative sample |
| 13 | 0.25 | 1.75 | $\frac{1}{6.5}$ | 30 | | Present invention |
| 14 | 0.04 | 0.21 | $\frac{1}{5.3}$ | 8 | | Comparative sample |
| 15 | 0.57 | 16.2 | $\frac{1}{28.4}$ | 58 | low strength and poor dyeability | Comparative sample |
| 16 | 0.34 | 14.3 | $\frac{1}{42.1}$ | 36 | poor dyeability | Comparative sample |

TABLE 2(b)

| Experiment number | Void: Porosity, V ($cm^3/g$) | Void: Surface area, A ($m^2/g$) | Void: V/A | Fiber property: Water absorption (%) | Fiber property: Others | Remarks |
|---|---|---|---|---|---|---|
| 17 | 0.41 | 13.9 | $\frac{1}{33.9}$ | 43 | poor dyeability | Comparative sample |
| 18 | 0.95 | 19.3 | $\frac{1}{20.3}$ | 94 | low strength and poor dyeability | Comparative sample |
| 19 | 0.25 | 17.4 | $\frac{1}{69.6}$ | 25 | poor dyeability | Comparative sample |
| 20 | 0.21 | 1.74 | $\frac{1}{8.3}$ | 24 | | Present invention |
| 21 | 0.02 | 1.01 | $\frac{1}{50.5}$ | 6 | | Comparative sample |
| 22 | 1.34 | 18.4 | $\frac{1}{13.7}$ | 132 | low strength | Comparative sample |
| 23 | 0.41 | 2.47 | $\frac{1}{6.0}$ | 43 | | Present invention |

EXAMPLE 2

The same modacrylic copolymer as used in Example 1 was used, and 3-denier porous flame-retardant acrylic synthetic fibers shown in the following Table 2 were produced by changing the composition of the polymer mixture, the extruding condition, the drawing condition, the drying condition and other production condi-

EXAMPLE 3

A polymer mixture consisting of 80 parts of a modacrylic copolymer, which had a composition of AN:VDC:SMAS=52:46:2(%), and 20 parts of cellulose acetate was dissolved in a solvent shown in the following Table 3 to prepare spinning solutions having a property shown in Table 3. The extrusion of the spinning solution and the aftertreatment of the extruded filaments were carried out under the same condition as described in Example 1 to obtain 3-denier fibers. However, as the coagulation bath, an aqueous solution containing the same solvent as that used in the spinning solution was used.

The properties of the fibers are shown in Table 3. In Table 3, the viscosity of the spinning solution was measured at 50° C. by means of a Brookfield viscometer. The stability of the spinning solution was estimated by the stability against gellation at 50° C. and by the stability of the dispersion of the modacrylic copolymer and cellulose acetate in the spinning solution.

TABLE 3(a)

| | Spinning solution | | | | Void | | | Fiber property | | | |
|---|---|---|---|---|---|---|---|---|---|---|---|
| Experiment number | Solvent | Concentration of polymer mixture (%) | Viscosity (poise) | Stability | Porosity, V ($cm^3/g$) | Surface area, A ($m^2/g$) | V/A | Water absorption (%) | Strength (g/d) | Operability | Remarks |
| 24 | Dimethyl formamide | 10 | 3.5 | good | 0.46 | 14.9 | $\frac{1}{32.4}$ | 48 | 2.0 | good | Comparative sample |
| 25 | Dimethyl formamide | 15 | 9.6 | " | 0.37 | 2.51 | $\frac{1}{6.8}$ | 39 | 2.5 | " | Present invention |
| 26 | Dimethyl formamide | 20 | 27 | " | 0.33 | 2.13 | $\frac{1}{6.5}$ | 35 | 2.6 | " | Present invention |
| 27 | Dimethyl formamide | 25 | 84 | " | 0.31 | 2.09 | $\frac{1}{6.7}$ | 34 | 2.6 | " | Present invention |
| 28 | Dimethyl formamide | 30 | 230 | " | 0.29 | 2.22 | $\frac{1}{7.7}$ | 32 | 2.7 | " | Present invention |
| 29 | Dimethyl formamide | 35 | 700 | somewhat poor | 0.28 | 2.07 | $\frac{1}{7.4}$ | 31 | 2.8 | somewhat poor | Present invention |
| 30 | Dimethyl formamide | 40 | >1,000 | poor | 0.25 | 1.95 | $\frac{1}{7.8}$ | 28 | 2.8 | poor | Comparative sample |

TABLE 3(b)

| | Spinning solution | | | | Void | | | Fiber property | | | |
|---|---|---|---|---|---|---|---|---|---|---|---|
| Experiment number | Solvent | Concentration of polymer mixture (%) | Viscosity (poise) | Stability | Porosity, V ($cm^3/g$) | Surface area, A ($m^2/g$) | V/A | Water absorption (%) | Strength (g/d) | Operability | Remarks |
| 31 | Dimethyl acetamide | 10 | 4.7 | good | 0.48 | 14.5 | $\frac{1}{30.2}$ | 50 | 2.0 | good | Comparative sample |
| 32 | Dimethyl acetamide | 15 | 13 | " | 0.38 | 2.19 | $\frac{1}{5.8}$ | 40 | 2.4 | " | Present invention |
| 33 | Dimethyl acetamide | 20 | 39 | " | 0.37 | 2.23 | $\frac{1}{6.0}$ | 39 | 2.5 | " | Present invention |
| 34 | Dimethyl acetamide | 25 | 110 | " | 0.35 | 2.11 | $\frac{1}{6.0}$ | 37 | 2.6 | " | Present invention |
| 35 | Dimethyl acetamide | 30 | 330 | " | 0.32 | 1.93 | $\frac{1}{6.0}$ | 34 | 2.7 | " | Present invention |
| 36 | Dimethyl acetamide | 35 | 950 | somewhat poor | 0.34 | 1.97 | $\frac{1}{5.8}$ | 36 | 2.8 | somewhat poor | Present invention |
| 37 | Dimethyl acetamide | 40 | >1,000 | poor | 0.29 | 1.85 | $\frac{1}{6.4}$ | 32 | 2.7 | poor | Comparative sample |

TABLE 3(c)

| | Spinning solution | | | | Void | | | Fiber property | | | |
|---|---|---|---|---|---|---|---|---|---|---|---|
| Experiment number | Solvent | Concentration of polymer mixture (%) | Viscosity (poise) | Stability | Porosity, V ($cm^3/g$) | Surface area, A ($m^2/g$) | V/A | Water absorption (%) | Strength (g/d) | Operability | Remarks |
| 38 | Dimethyl sulfoxide | 10 | 9.0 | good | 0.45 | 13.9 | $\frac{1}{30.9}$ | 47 | 2.1 | good | Comparative sample |

TABLE 3(c)-continued

| Experiment number | Spinning solution: Solvent | Concentration of polymer mixture (%) | Viscosity (poise) | Stability | Void: Porosity, V ($cm^3/g$) | Void: Surface area, A ($m^2/g$) | Void: V/A | Fiber property: Water absorption (%) | Fiber property: Strength (g/d) | Fiber property: Operability | Remarks |
|---|---|---|---|---|---|---|---|---|---|---|---|
| 39 | Dimethyl sulfoxide | 15 | 26 | " | 0.37 | 2.31 | $\frac{1}{6.2}$ | 39 | 2.3 | " | Present invention |
| 40 | Dimethyl sulfoxide | 20 | 80 | " | 0.36 | 2.27 | $\frac{1}{6.3}$ | 38 | 2.5 | " | Present invention |
| 41 | Dimethyl sulfoxide | 25 | 220 | " | 0.33 | 1.98 | $\frac{1}{6.0}$ | 35 | 2.7 | " | Present invention |
| 42 | Dimethyl sulfoxide | 30 | 660 | " | 0.29 | 2.13 | $\frac{1}{7.3}$ | 32 | 2.8 | " | Present invention |
| 43 | Dimethyl sulfoxide | 35 | >1,000 | somewhat poor | 0.31 | 2.07 | $\frac{1}{6.7}$ | 34 | 2.8 | somewhat poor | Present invention |
| 44 | Dimethyl sulfoxide | 40 | gelled | poor | 0.25 | 1.80 | $\frac{1}{7.2}$ | 29 | 2.9 | poor | Comparative sample |

TABLE 4

| Experiment number | Draw ratio in primary drawing | Void: Porosity, V ($cm^3/g$) | Void: Surface area, A ($m^2/g$) | Void: V/A | Fiber property: Water absorption (%) | Fiber property: Others | Remarks |
|---|---|---|---|---|---|---|---|
| 45 | 1.5 | 0.45 | 4.37 | $\frac{1}{9.7}$ | 47 | filaments are brittle, and operability in drawing and in successive treatments is poor | Comparative sample |
| 46 | 2 | 0.38 | 2.24 | $\frac{1}{5.9}$ | 40 | filaments are brittle, and operability in drawing and in successive treatments is poor | Comparative sample |
| 47 | 3 | 0.32 | 1.82 | $\frac{1}{5.7}$ | 34 | | Present invention |
| 48 | 4 | 0.35 | 1.82 | $\frac{1}{5.2}$ | 37 | | Present invention |
| 49 | 5 | 0.34 | 1.80 | $\frac{1}{5.3}$ | 36 | | Present invention |
| 50 | 6 | 0.32 | 1.63 | $\frac{1}{5.1}$ | 34 | | Present invention |
| 51 | 7 | 0.31 | 1.49 | $\frac{1}{4.8}$ | 34 | | Present invention |
| 52 | 8 | 0.15 | 0.92 | $\frac{1}{6.1}$ | 18 | | Present invention |
| 53 | 9 | 0.09 | 0.51 | $\frac{1}{5.7}$ | 12 | poor operablility | Comparative sample |

EXAMPLE 4

A polymer mixture consisting of 85 parts of a modacrylic copolymer, which had a composition of AN:VDC:sodium allylsulfonate (hereinafter abbreviated as SAS)=53.5:44.0:2.5(%), and 15 parts of cellulose acetate was dissolved in DMF to prepare a spinning solution containing 27% of the polymer mixture. The spinning solution was extruded from a spinneret into a coagulation bath consisting of 65% of DMF and 35% of water and kept at 20° C., and the extruded filaments were subjected to a primary drawing in various draw ratios shown in the following Table 4. The primarily drawn filaments were dried and after-treated under the same conditions as described in Example 1 to obtain 5-denier fibers. The properties of the resulting fibers are shown in Table 4.

EXAMPLE 5

A polymer mixture consisting of 80 parts of a modacrylic copolymer, which had a composition of AN:VDC:SMAS=48.5:50.0:1.5(%), and 20 parts of cellulose acetate was dissolved in DMF to prepare a spinning solution containing 27% of the polymer mixture, and the spinning solution was extruded from a spinneret into a coagulation bath consisting of 56% of DMF and 44% of water and kept at 20° C. The extruded filaments were subjected to a primary drawing to draw the filaments to 5.0 times their original length, and then dried until the water content of the filaments was decreased to not more than 0.8% by means of a hot roller type drier kept at a drying temperature shown in the following Table 5. The dried filaments were then subjected to a secondary drawing at 110° C. under wet heat to draw the filaments to 2 times their original length, and then mechanically crimped, and the crimps were set to obtain 3-denier fibers. The properties of the fibers are shown in Table 5.

TABLE 5

| Experiment number | Drying temperature (°C.) | Void: Porosity, V ($cm^3/g$) | Void: Surface area, A ($m^2/g$) | Void: V/A | Fiber property: Water absorption (%) | Fiber property: Others | Remarks |
|---|---|---|---|---|---|---|---|
| 54 | 80 | 0.70 | 26.2 | $\frac{1}{37}$ | 68 | low strength and poor dyeability | Comparative sample |
| 55 | 100 | 0.48 | 9.8 | $\frac{1}{20}$ | 50 | somewhat poor dyeability | Present invention |
| 56 | 120 | 0.32 | 2.11 | $\frac{1}{6.6}$ | 34 | | Present invention |
| 57 | 140 | 0.31 | 2.04 | $\frac{1}{6.6}$ | 34 | | Present invention |
| 58 | 160 | 0.29 | 1.70 | $\frac{1}{5.9}$ | 32 | | Present invention |
| 59 | 180 | 0.27 | 1.48 | $\frac{1}{5.5}$ | 30 | somewhat colors | Present invention |
| 60 | 200 | 0.26 | 1.44 | $\frac{1}{5.5}$ | 21 | colors, and becomes hard | Comparative sample |

TABLE 6

| Experiment number | Water content (%) | Void: Porosity, V ($cm^3/g$) | Void: Surface area, A ($m^2/g$) | Void: V/A | Fiber property: Water absorption (%) | Fiber property: Others | Remarks |
|---|---|---|---|---|---|---|---|
| 61 | 0.1 | 0.31 | 1.52 | $\frac{1}{4.9}$ | 30 | | Present invention |
| 62 | 0.2 | 0.32 | 1.92 | $\frac{1}{6.0}$ | 34 | | Present invention |
| 63 | 0.4 | 0.33 | 2.11 | $\frac{1}{6.4}$ | 35 | | Present invention |
| 64 | 0.6 | 0.34 | 2.21 | $\frac{1}{6.5}$ | 36 | | Present invention |
| 65 | 0.9 | 0.33 | 2.21 | $\frac{1}{6.7}$ | 35 | | Present invention |
| 66 | 1.0 | 0.37 | 2.70 | $\frac{1}{7.3}$ | 39 | | Present invention |
| 67 | 1.5 | 0.48 | 14.9 | $\frac{1}{31.0}$ | 50 | poor dyeability, and uneven yarn property and dyeability | Comparative sample |
| 68 | 3.0 | 0.51 | 23.0 | $\frac{1}{45}$ | 53 | poor dyeability, and uneven yarn property and dyeability | Comparative sample |

EXAMPLE 6

The same spinning solution as that used in Example 5 was extruded from a spinneret into a coagulation bath consisting of 56% of DMF and 44% of water and kept at 20° C. The extruded filaments were subjected to a primary drawing to draw the filaments to 4.5 times their original length, and the primarily drawn filaments were dried by means of a hot roller type drier kept at 120° C. to decrease the water content of the filaments to the water contents shown in the following Table 6, and the dried filaments were subjected to a secondary drawing at 110° C. under wet heat to draw the filaments to 1.6 times their original length. The secondarily drawn filaments were crimped and the crimps were set to obtain 3-denier fibers. The properties of the resulting fibers are shown in Table 6.

EXAMPLE 7

The same spinning solution as that used in Example 5 was extruded from a spinneret into a coagulation bath consisting of 56% of DMF and 44% of water and kept at 20° C., and the extruded filaments were subjected to a primary drawing to draw the filaments to 5 times their original length. Then, the primarily drawn filaments were dried by means of a hot roller type drier kept at 120° C. until the water content of the filaments was decreased to 0.5%. The dried filaments were subjected to a secondary drawing under the secondary drawing condition shown in the following Table 7 and then mechanically crimped, and the crimps were set to obtain 2-denier fibers. The properties of the fibers are shown in Table 7. In Table 7, the temperature in the secondary drawing is a wet heat temperature.

TABLE 7(a)

| Experiment number | Secondary drawing condition: Temperature (°C.) | Secondary drawing condition: Draw ratio | Void: Porosity, V ($cm^3/g$) | Void: Surface area, A ($m^2/g$) | Void: V/A | Fiber property: Water absorption (%) | Operability | Remarks |
|---|---|---|---|---|---|---|---|---|
| 69 | 100 | 0.9 | 0.34 | 2.01 | 1/5.9 | 36 | | Present invention |
| 70 | " | 1.0 | 0.36 | 2.21 | 1/6.1 | 38 | | Present invention |
| 71 | " | 1.5 | 0.37 | 2.15 | 1/5.8 | 39 | | Present invention |
| 72 | " | 2 | 0.33 | 2.11 | 1/6.4 | 35 | | Present invention |
| 73 | " | 3 | 0.22 | 1.94 | 1/8.8 | 25 | yarn breakage occurs in secondary drawing | Present invention |
| 74 | 110 | 0.9 | 0.32 | 1.85 | 1/5.8 | 34 | | Present invention |
| 75 | " | 1.0 | 0.34 | 1.87 | 1/5.5 | 36 | | Present invention |

TABLE 7(b)

| Experiment number | Secondary drawing condition: Temperature (°C.) | Secondary drawing condition: Draw ratio | Void: Porosity, V ($cm^3/g$) | Void: Surface area, A ($m^2/g$) | Void: V/A | Fiber property: Water absorption (%) | Operability | Remarks |
|---|---|---|---|---|---|---|---|---|
| 76 | 110 | 2 | 0.30 | 2.01 | 1/6.7 | 33 | | Present invention |
| 77 | " | 3 | 0.29 | 2.11 | 1/7.3 | 32 | yarn breakage occurs somewhat | Present invention |
| 78 | " | 4 | 0.20 | 2.04 | 1/10.2 | 23 | yarn breakage occurs often | Comparative sample |
| 79 | 120 | 0.8 | 0.34 | 1.87 | 1/5.5 | 36 | | Present invention |
| 80 | " | 1 | 0.35 | 1.94 | 1/5.5 | 37 | | Present invention |
| 81 | " | 2 | 0.31 | 1.97 | 1/6.4 | 34 | | Present invention |
| 82 | " | 3 | 0.25 | 2.15 | 1/8.6 | 28 | yarn breakage occurs somewhat | Present invention |
| 83 | " | 4 | 0.21 | 2.21 | 1/10.5 | 24 | yarn breakage occurs often | Comparative sample |

TABLE 7(c)

| Experiment number | Secondary drawing condition: Temperature (°C.) | Secondary drawing condition: Draw ratio | Void: Porosity, V ($cm^3/g$) | Void: Surface area, A ($m^2/g$) | Void: V/A | Fiber property: Water absorption (%) | Operability | Remarks |
|---|---|---|---|---|---|---|---|---|
| 84 | 120 | 5 | — | — | — | — | operation is impossible | Comparative sample |

TABLE 7(c)-continued

| Experiment number | Secondary drawing condition: Temperature (°C.) | Secondary drawing condition: Draw ratio | Void: Porosity, V ($cm^3/g$) | Void: Surface area, A ($m^2/g$) | Void: V/A | Fiber property: Water absorption (%) | Operability | Remarks |
|---|---|---|---|---|---|---|---|---|
| 85 | 130 | 0.8 | 0.35 | 1.61 | 1/4.6 | 37 | | Present invention |
| 86 | " | 1 | 0.34 | 1.74 | 1/5.1 | 36 | | Present invention |
| 87 | " | 2 | 0.30 | 1.80 | 1/6.0 | 33 | | Present invention |
| 88 | " | 3 | 0.25 | 1.95 | 1/7.8 | 28 | yarn breakage occurs somewhat | Present invention |
| 89 | " | 4 | 0.22 | 2.01 | 1/9.1 | 25 | yarn breakage occurs often | Comparative sample |
| 90 | " | 5 | — | — | — | — | operation is impossible | Comparative sample |

EXAMPLE 8

A polymer mixture consisting of 78 parts of a modacrylic copolymer, which had a composition of AN:VDC:SAS=53.5:44.0:2.5(%), 20 parts of cellulose acetate and 2 parts of antimony oxide was dissolved in DMF to prepare a spinning solution containing 25% of the polymer mixture. The spinning solution was extruded from a spinneret into a coagulation bath consisting of 60% of DMF and 40% of water and kept at 20° C. The extruded filaments were subjected to a primary drawing to draw the filaments to 4.8 times their original length. The primarily drawn filaments was dried until the water content of the filaments was decreased to 0.5% by means of a hot roller type drier kept at 125° C. while blowing hot air kept at 135° C. The dried filaments were subjected to a secondary drawing at 105° C. under wet heat to draw the filaments to 1.5 times their original length and then mechanically crimped, and the crimps were set to obtain 3-denier porous flame-retardant acrylic synthetic fibers.

The resulting fibers had yarn properties of a strength in dried state of 2.7 g/d and an elongation in dried state of 30.5%; and a porosity V of 0.31 $cm^3/g$ and a surface area A of voids of 1.78 $m^2/g$, the ratio V/A being 1/5.7; and a water absorption of 54%. Further, the fibers had Oxygen Index of 29, that is, a high flame resistance.

EXAMPLE 9

A polymer mixture consisting of (100-C) parts of a modacrylic copolymer (I), which had a composition of An:VDC:SMAS=58:40:2(%), C parts of cellulose acetate (II), and 2 parts, based on 100 parts of the total amount of the polymers (I) and (II), of an acrylic copolymer (III), which had a composition of AN:$CH_2$=-CH-(COO)-$CH_2CH_2O)_{10}H$=90:10(%), was dissolved in DMF to prepare a spinning solution containing 25% of the polymer mixture. The spinning solution was extruded from a spinneret into a coagulation bath consisting of 56% of DMF and 44% of water and kept at 20° C., and the extruded filaments were subjected to a primary drawing to draw the filaments to 5 times their original length. The primarily drawn filaments were dried until the water content in the filaments were decreased to 0.7% by means of a hot roller type driver kept at 120° C., and then subjected to a secondary drawing at 100° C. under wet heat to draw the filaments to 1.1 times their original length. The filaments were mechanically crimped, and the crimps were set to obtain 3-denier fibers. The properties of the fibers are shown in the following Table 8.

TABLE 8

| Experiment number | Polymer mixture (parts): [I] | [II] | [III] | Void: Porosity, V ($cm^3/g$) | Void: Surface area, A ($m^2/g$) | Void: V/A | Fiber property: Water absorption (%) | Others | Remarks |
|---|---|---|---|---|---|---|---|---|---|
| 91 | 95 | 5 | 2 | 0.13 | 1.24 | 1/9.5 | 18 | | Present invention |
| 92 | 90 | 10 | 2 | 0.21 | 1.49 | 1/7.1 | 25 | | Present invention |
| 93 | 80 | 20 | 2 | 0.34 | 1.98 | 1/5.8 | 34 | | Present invention |
| 94 | 70 | 30 | 2 | 0.47 | 2.31 | 1/4.9 | 46 | | Present invention |
| 95 | 50 | 50 | 2 | 0.71 | 4.12 | 1/5.8 | 70 | | Present invention |

TABLE 8-continued

| Experiment number | Polymer mixture (parts) [I] | [II] | [III] | Void: Porosity, V ($cm^3/g$) | Void: Surface area, A ($m^2/g$) | V/A | Fiber property: Water absorption (%) | Others | Remarks |
|---|---|---|---|---|---|---|---|---|---|
| 96 | 40 | 60 | 2 | 1.02 | 5.61 | $\frac{1}{5.5}$ | 96 | low in strength and elongation, and poor in dyeability | Comparative sample |

EXAMPLE 10

A polymer mixture consisting of 85 parts of a modacrylic copolymer (I), which had a composition of AN:VDC:SMAS=58.5:40:1.5(%), 15 parts of cellulose acetate (II), and a variable amount of an acrylic copolymer (III), which had a composition of AN:$CH_2$=-CH—COO—$CH_2CH_2O)_9CH_3$=85:15(%), was dissolved in DMF to prepare a spinning solution containing 23% of the polymer mixture. The extrusion of the spinning solution and the after-treatment of the extruded filaments were carried out under the same conditions as described in Example 9 to obtain 3-denier fibers. The properties of the fibers are shown in the following Table 9.

TABLE 9

| Experiment number | Polymer mixture (parts) [I] | [II] | [III] | Void: Porosity, V ($cm^3/g$) | Void: Surface area, A ($m^2/g$) | V/A | Fiber property: Water absorption (%) | Others | Remarks |
|---|---|---|---|---|---|---|---|---|---|
| 97 | 85 | 15 | 0.5 | 0.30 | 1.98 | $\frac{1}{6.6}$ | 33 | good in luster and in dyeability | Present invention |
| 98 | " | " | 2 | 0.29 | 1.96 | $\frac{1}{6.8}$ | 31 | good in luster and in dyeability | Present invention |
| 99 | " | " | 5 | 0.27 | 1.71 | $\frac{1}{6.3}$ | 29 | good in luster and in dyeability | Present invention |
| 100 | " | " | 10 | 0.23 | 1.63 | $\frac{1}{7.1}$ | 25 | good in luster and in dyeability | Present invention |
| 101 | " | " | 30 | 0.18 | 1.18 | $\frac{1}{6.5}$ | 21 | good in luster and in dyeability | Present invention |
| 102 | " | " | 50 | 0.14 | 0.91 | $\frac{1}{6.5}$ | 17 | good in luster and in dyeability | Present invention |

EXAMPLE 11

A polymer mixture consisting of 85 parts of a modacrylic copolymer (I), which had a composition of AN:VDC:SAS=54:44:2(%), 15 parts of cellulose acetate (II) and 2 parts of an acrylic copolymer (III), which was a copolymer of 90% of AN and 10% of a monomer shown by the following general formula, was dissolved in DMF to prepare a spinning solution containing 27% of the polymer mixture. The extrusion of the spinning solution, and the aftertreatment of the extruded filaments were carried out under the same condition as described in Example 9 to obtain 3-denier fibers.

The general formula of the above described monomer is as follows:

$$CH_2{=}CH{-}COOX$$

wherein X represents $R_2$ or $$\text{-}(CH_2CH_2O)_l\text{-}(CH_2\overset{\overset{CH_3}{|}}{C}HO)_m\text{-}R_3$$

($R_2$, $R_3$, l and m are shown in the following Table 10).

The properties of the resulting fibers are shown in Table 10.

TABLE 10

| Experiment number | Monomer: $R_2$ | $R_3$ | l | m | Void: Porosity, V ($cm^3/g$) | Void: Surface area, A ($m^2/g$) | V/A | Water absorption (%) | Remarks |
|---|---|---|---|---|---|---|---|---|---|
| 103 | H | — | — | — | 0.26 | 1.43 | $\frac{1}{5.5}$ | 29 | Present invention |
| 104 | — | H | 8 | 0 | 0.31 | 1.97 | $\frac{1}{6.4}$ | 34 | Present invention |
| 105 | — | H | 0 | 15 | 0.34 | 1.86 | $\frac{1}{5.5}$ | 35 | Present invention |
| 106 | — | $CH_3$ | 10 | 15 | 0.33 | 1.91 | $\frac{1}{5.8}$ | 36 | Present invention |

TABLE 10-continued

| Experiment number | Monomer $R_2$ | $R_3$ | l | m | Void Porosity, V ($cm^3/g$) | Surface area, A ($m^2/g$) | V/A | Water absorption (%) | Remarks |
|---|---|---|---|---|---|---|---|---|---|
| 107 | — | H | 20 | 20 | 0.41 | 2.05 | $\frac{1}{5.0}$ | 43 | Present invention |

What is claimed is:

1. A porous, flame-retardant, acrylic, synthetic fiber, in which the polymeric component of said fiber consists of a mixture of (A) from 2 to 50% by weight of cellulose acetate, and (B) from 50 to 98% by weight of a polymer material selected from the group consisting of 1. modacrylic copolymer consisting of from (i) 20 to 60% by weight of at least one of vinyl chloride and vinylidene chloride, (ii) less than 5% by weight of a copolymerizable monomer different from vinyl chloride, vinylidene chloride and acrylonitrile, and (iii) the balance is acrylonitrile, and
2. mixture of said modacrylic copolymer and an acrylic copolymer consisting of (i) from 5 to 30% by weight of monomer having the formula

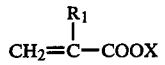

wherein $R_1$ is H or $CH_3$, X is selected from the group consisting of H, $NH_4$, alkali metal and

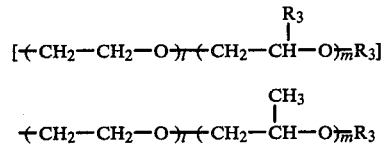

wherein $R_3$ is H or $CH_3$, and l and m are integers of from 0 to 50 and $0<l+m\leqq 50$, (ii) at least 70% by weight of acrylonitrile and (iii) the balance is said copolymerizable monomer, with the proviso that the amount of said acrylic copolymer is not greater than 33% by weight, based on the total weight of said polymeric component of said fiber, said fiber having a surface area A of voids of not greater than 15 $m^2/g$, a porosity V of from 0.05 to 0.75 $cm^3/g$ and the ratio of porosity V/surface area A being 1/30 or more, said fiber having mainly macrovoids formed by phase separation of said cellulose acetate and said modacrylic copolymer.

2. A fiber as claimed in claim 1 in which said polymer material (B) consists of said modacrylic copolymer.

3. A fiber as claimed in claim 1 in which said polymer material (B) consists of said mixture of said modacrylic copolymer and said acrylic copolymer.

4. The fiber as claimed in claim 1, claim 2 or claim 3, wherein the modacrylic copolymer contains 30 to 50 by weight of at least one of vinyl chloride and vinylidene chloride.

5. The fiber as claimed in claim 1, claim 2 or claim 3, modacrylic copolymer contains 0.5 to 3.0 by weight of a copolymerizable monomer having sulfonic acid group.

6. The fiber as claimed in claim 5, wherein the copolymerizable monomer is sodium methallylsulfonate and/or sodium allylsulfonate.

7. The fiber as claimed in claim 1, claim 2 or claim 3, wherein the cellulose acetate is distributed in the fiber in an elongated form having the longest dimension parallel to the fiber axis.

8. The fiber as claimed in claim 1, claim 2 or claim 3, wherein the surface area A of the voids is 0.02 to 10 $m^2/g$.

9. The fiber as claimed in claim 1, claim 2 or claim 3, wherein the porosity V is 0.05 to 0.60 $cm^3/g$.

10. The fiber as claimed in claim 1, claim 2 or claim 3, wherein V/A is 1/20 or more.

* * * * *

UNITED STATES PATENT AND TRADEMARK OFFICE

CERTIFICATE OF CORRECTION

PATENT NO. : 4 346 146

DATED : August 24, 1982

INVENTOR(S) : Yoshikazu Kondo et al

It is certified that error appears in the above—identified patent and that said Letters Patent is hereby corrected as shown below:

Column 24, line 26; change "50" to ---50%---.

Column 24, line 29; after "3," insert ---wherein the---.

Column 24, line 30; after "3.0" insert ---%---.

Signed and Sealed this

*First* Day of *February 1983*

[SEAL]

*Attest:*

GERALD J. MOSSINGHOFF

*Attesting Officer* *Commissioner of Patents and Trademarks*